US007508289B1

(12) United States Patent
Wernicki

(10) Patent No.: US 7,508,289 B1
(45) Date of Patent: Mar. 24, 2009

(54) COOLED HIGH POWER VEHICLE INDUCTOR AND METHOD

(75) Inventor: Paul F. Wernicki, Oxnard, CA (US)

(73) Assignee: ISE Corporation, Poway, CA (US)

( * ) Notice: Subject to any disclaimer, the term of this patent is extended or adjusted under 35 U.S.C. 154(b) by 0 days.

(21) Appl. No.: 12/013,211

(22) Filed: Jan. 11, 2008

(51) Int. Cl.
*H01F 27/08* (2006.01)

(52) U.S. Cl. ..... 336/55; 336/65; 336/61

(58) Field of Classification Search ..... 336/213, 336/55, 57, 58, 59, 60, 61
See application file for complete search history.

(56) References Cited

U.S. PATENT DOCUMENTS

| | | | | |
|---|---|---|---|---|
| 3,774,298 | A * | 11/1973 | Eley | 29/605 |
| 4,337,569 | A * | 7/1982 | Pierce | 29/605 |
| 4,394,635 | A * | 7/1983 | Foss | 336/55 |
| 6,144,276 | A | 11/2000 | Booth | |
| 6,278,353 | B1 | 8/2001 | Downing et al. | |
| 7,129,808 | B2 | 10/2006 | Roebke et al. | |
| 7,205,875 | B2 | 4/2007 | Oughton, Jr. et al. | |
| 7,245,197 | B2 | 7/2007 | Helosvuori et al. | |
| 7,292,127 | B2 * | 11/2007 | Yamashita et al. | 336/216 |
| 2004/0070475 | A1 | 4/2004 | Nick et al. | |
| 2006/0250205 | A1 | 11/2006 | De et al. | |
| 2007/0080769 | A1 | 4/2007 | Thiel et al. | |
| 2007/0222413 | A1 * | 9/2007 | Kinoshita et al. | 320/104 |

OTHER PUBLICATIONS

J.W. McKeever, S.C. Nelson, and G.J. Su, "Boost Converters for Gas Electric and Fuel Cell Hybrid Electric Vehicles," Oak Ridge National Lab, ORNL/TM-2005/60, May 27, 2005.

* cited by examiner

*Primary Examiner*—Anh T Mai
(74) *Attorney, Agent, or Firm*—Stephen C. Beuerle; Procopio Cory Hargreaves & Savitch LLP

(57) ABSTRACT

A cooled high-power vehicle inductor includes an inductor core including a central axis; a first series of inductor windings around the central axis of the cooled high-power vehicle inductor, the first series of inductor windings having an outer perimeter; a second series of inductor windings around the central axis of the cooled high-power vehicle inductor, the second series of inductor windings having an inner perimeter that is substantially outside the outer perimeter of the first series of inductor windings, wherein the second series of inductor windings is electrically coupled to the first series of inductor windings; and a first heat transfer insert that is disposed between the outer perimeter of the first series of inductor windings and the inner perimeter of the second series of inductor windings, the first heat transfer insert forming a heat transfer path.

18 Claims, 13 Drawing Sheets

COOLED HIGH POWER VEHICLE INDUCTOR AND METHOD

FIELD OF THE INVENTION

The field of the invention relates to hybrid electric vehicles (HEVs) and high power hybrid drive systems. In particular, the field of the invention relates to systems and methods for cooling high-power inductors specially adapted for HEVs and electric vehicles (EVs).

BACKGROUND OF THE INVENTION

A hybrid electric vehicle (HEV) is a vehicle which combines a conventional propulsion system with an on-board rechargeable energy storage system to achieve better fuel economy and cleaner emissions than a conventional vehicle. In a parallel configuration (not shown), an HEV will commonly use an internal combustion engine and batteries or ultracapacitors to power electric propulsion, however the ICE will also provide mechanical power to the drive wheels.

Referring to FIG. 22, in a series configuration, an HEV drive system 2200 will commonly use an energy source such as an internal combustion engine (ICE) 2210 and a pack 2220 of batteries or ultracapacitors to provide electric propulsion power to the drive wheel assembly 2230. In particular, the ICE 2210 will be coupled to a generator 2212, which will generate electricity to power one or more electric propulsion motor(s) 2232 and/or charge the energy storage 2220. Also, multiple electric propulsion motor(s) 2232 may also be mechanically coupled via a combining gearbox 2236. Propulsion motor(s) 2232 for heavy duty vehicles (i.e., having a gross weight of over 10,000) may include two AC induction motors that produce 50-150 kW of power (×2) and having a rated DC voltage of 650 VDC. Due to the high temperatures generated, high power electronic components such as the generator 2212 and electric propulsion motor(s) 2232 will typically be cooled (e.g., water-glycol cooled), and may be included in the same cooling loop as the ICE 2210. Additionally, since the ICE's 2210 primary function here is simply to drive the electric generator, the ICE 2210 may be optimized for limited range of operation and can run more efficiently than a conventional ICE, which must be designed to provide drive power over various speed and loading profiles.

As an added feature, rather than dissipating kinetic energy via friction braking, many HEVs recapture the kinetic energy of the vehicle. In particular, kinetic energy is recaptured via regenerative braking, wherein the electric propulsion motor (s) 2232 are switched to operate as generators, and a torque is applied to the drive wheel assembly 2230. This torque results in a net braking force on the vehicle. As the vehicle slows, it transfers its kinetic energy to the motor(s) 2232, now operating as a generator(s), and electricity is generated. The electricity generated is then stored in the energy storage 2220 to be used later in the drive cycle. Regenerative braking may also incorporated into an all-electric vehicle thereby providing a source of electricity generation onboard the vehicle.

When the energy storage 2220 reaches a predetermined capacity (e.g., fully charged), the HEV may then dissipate any additional regenerated electricity through a resistive braking resistor 2240. Typically, the braking resistor 2240 will also be included in the cooling loop of the ICE 2210. By recapturing its own kinetic energy, the demand on the ICE 2210 to generate energy is also reduced, thus making the HEV drive system 2200 even more efficient.

An HEV drive system 2200 may include multiple energy sources. Examples of typical HEV energy sources include: an engine 2210 (e.g., ICE, fuel cell, CNG, etc.) mechanically coupled to a generator 2212, an energy storage device 2220 (e.g., battery, ultracapacitor, flywheel, etc.), and a reconfigurable electric propulsion motor 2232 mechanically coupled to the drive wheel assembly 2230. These energy sources may then be electrically coupled to a buss, in particular a DC high power buss 2250. In this way, energy can be transferred between components of the high power hybrid drive system as needed.

An HEV may further include both AC and DC high power systems. For example, the drive system 2200 may generate and run on high power AC, but convert it to DC for storage and/or transfer between components across the DC high power buss 2250. Accordingly, the current may be converted via an inverter/rectifier 2214, 2234 or other suitable device (hereinafter "inverters"). Inverters 2214, 2234 for heavy duty vehicles (i.e., having a gross weight of over 10,000) may include a high frequency IGBT multiple phase water-glycol cooled inverter with a rated DC voltage of 650 VDC having a peak current of 300 A. As illustrated, HEV drive system 2200 includes a first inverter 2214 interspersed between the generator 2212 and the DC high power buss 2250, and a second inverter 2234 interspersed between the generator 2232 and the DC high power buss 2250. Here the inverters 2214, 2234 are shown as separate devices, however it is understood that their functionality can be incorporated into a single unit.

In addition to utilizing different type electrical currents, not all energy sources of drive system 2200 provide an identical and/or static energy profile. For example, energy storage 2220, comprising a bank of ultracapacitors in series, may have an initial DC voltage of 700 VDC, however, its voltage decreases significantly as it discharges, proportionally to its static charge. Propulsion motor(s) 2232 for heavy duty vehicles may require an operational voltage on the order of 650 VDC or more. Accordingly, in order to provide sufficient operating voltage when the energy storage is discharging, it may be desirable to substantially step up the voltage of the energy storage from an available voltage to an operational voltage.

One technique for efficiently increasing the voltage of the electricity available on the DC buss 2250 involves using an inductor-based boost converter, DC-DC converter, or chopper (hereinafter "DC-DC converter"). See for example, J. W. McKeever, S. C. Nelson, and G. J. Su, "*Boost Converters for Gas Electric and Fuel Cell Hybrid Electric Vehicles*," Oak Ridge National Laboratory, ORNL/TM-2005/60, May 27, 2005. With a high power electric drive system, such as found in metropolitan transit buses, trolley cars, refuse collection trucks, and other heavy duty vehicles, the DC-DC converter may see DC currents on the order of 300 A at 800 VDC.

Unlike much lower rated circuits and systems, a heavy duty HEV/EV will require a high power inductor specially adapted for both the much higher loading and the unique mobile environment of a heavy duty vehicle (e.g., heat, vibration, environmental exposure, high reliability, etc). More importantly, at these ratings, heat becomes a major factor in the device's performance. Toroid-type high power inductors have been used with some success in this application, wherein the inductor casing is mated to a heat sink, to improve the inductor's performance. Toroidal inductors can have higher Q factors and higher inductance than similarly constructed solenoid coils. However, under the conditions of a heavy duty HEV/EV, the dissipation of heat is a limiting factor of an inductor's/inductor-based high power component's performance.

As the demand for HEVs and EVs increase, consumer demand for vehicle performance will also increase. Consumers will require greater performance and greater efficiency. With regard to DC-DC converters on HEVs and EVs, increased performance is associated with larger components; however it is desirable that large, bulky components on the vehicle, such as the heavy duty inductor become smaller and more lightweight. In addition, consumers will desire maximum performance at minimum cost. The invention seeks to address the abovementioned problems.

SUMMARY OF THE INVENTION

The inventor has discovered that a wound inductor that includes a heat transfer path within the windings themselves significantly increases its performance over existing externally cooled inductors. In fact, in an HEV high power solenoid-type inductor-based DC-DC converter, by extracting heat from within the inductor windings, where it is hottest, one may see a three-fold improvement of performance over externally cooled toroid-type inductor-based components. Moreover, this is significant as toroid-type inductors are considered preferred over solenoid-type inductors in high power applications.

Furthermore, EVs, and HEVs in particular, typically include onboard cooling systems and cooling sources that are not dedicated to a single system (e.g., the engine only). As such they may be readily adapted to the proposed cooled inductor. For example, referring to FIG. 22 and as discussed above, HEV drive system 2200 shares a single cooling system between ICE 2210, generator 2212, motor(s) 2232, and inverters 2214, 2234. Here, the same cooling system may also be used to provide cooling to DC-DC converter 2100.

The benefits of the cooled inductor may be realized in a pure performance improvement and/or a reduced size and weight requirement ("footprint") of the components. With a reduced footprint, the vehicle integrator has more options in the cooled inductor's placement, and may even incorporate it into a separate existing component (e.g., the inverters). Furthermore, this method of providing the vehicle with a cooled DC-DC converter (inductor) is amenable to low cost manufacture, which will be described further below. Heavy duty HEVs such as metropolitan transit buses may especially benefit, as maximum performance, here, is coupled to a lighter device having maximum efficiency, and as incremental improvements in this field may result in appreciable accumulated operational cost savings.

Accordingly, aspects of the invention involve a cooled high-power vehicle inductor, a method of manufacturing a cooled high-power vehicle inductor, and a method for cooling a high-power vehicle inductor.

The aspect of the invention involving a cooled high-power vehicle inductor involves an inductor core including a central axis; a first series of inductor windings around the central axis of the cooled high-power vehicle inductor, the first series of inductor windings having an outer perimeter; a second series of inductor windings around the central axis of the cooled high-power vehicle inductor, the second series of inductor windings having an inner perimeter that is substantially outside the outer perimeter of the first series of inductor windings, wherein the second series of inductor windings is electrically coupled to the first series of inductor windings; and a first heat transfer insert that is disposed between the outer perimeter of the first series of inductor windings and the inner perimeter of the second series of inductor windings, the first heat transfer insert forming a heat transfer path.

The aspect of the invention involving the method of manufacturing a cooled high-power vehicle inductor involves providing a first series of inductor windings around a central axis, the first series of inductor windings having an outer perimeter; positioning a first heat transfer insert along the outer perimeter of the first series of inductor windings, the first heat transfer insert forming a heat transfer path; and providing a second series of inductor windings around the central axis, the second series of inductor windings having an inner perimeter that is substantially outside the outer perimeter of the first series of inductor windings, wherein the second series of inductor windings is electrically coupled to the first series of inductor windings, and wherein the first heat transfer insert is disposed between the first and the second series of inductor windings.

The aspect of the invention involving the method of cooling a high-power inductor involves thermally coupling an external cooling source with the high-power inductor for removing heat from the high-power inductor; and using the external cooling assembly to remove heat from between the first and second series of inductor windings to cool the high-power inductor via the heat transfer path formed by the first heat transfer insert.

BRIEF DESCRIPTION OF THE DRAWINGS

The accompanying drawings, which are incorporated in, and form a part of this specification, illustrate embodiments of the invention and together with the description, serve to explain the principles of this invention.

DETAILED DESCRIPTION OF PREFERRED EMBODIMENTS

With reference to FIGS. 1A-1C and 22, an embodiment of a cooled high-power vehicle inductor 100, 2100 specially adapted for hybrid electric vehicles (HEVs) and electric vehicles (EVs) will be described. In the embodiment shown, the high-power inductor 100, 2100 is associated with a DC-to-DC converter in an inverter-DC buss boost circuit; however, in alternative embodiments, the cooled high-power vehicle inductor 100 may have a different construction and/or be used in a different application on the vehicle.

Figure 1A:
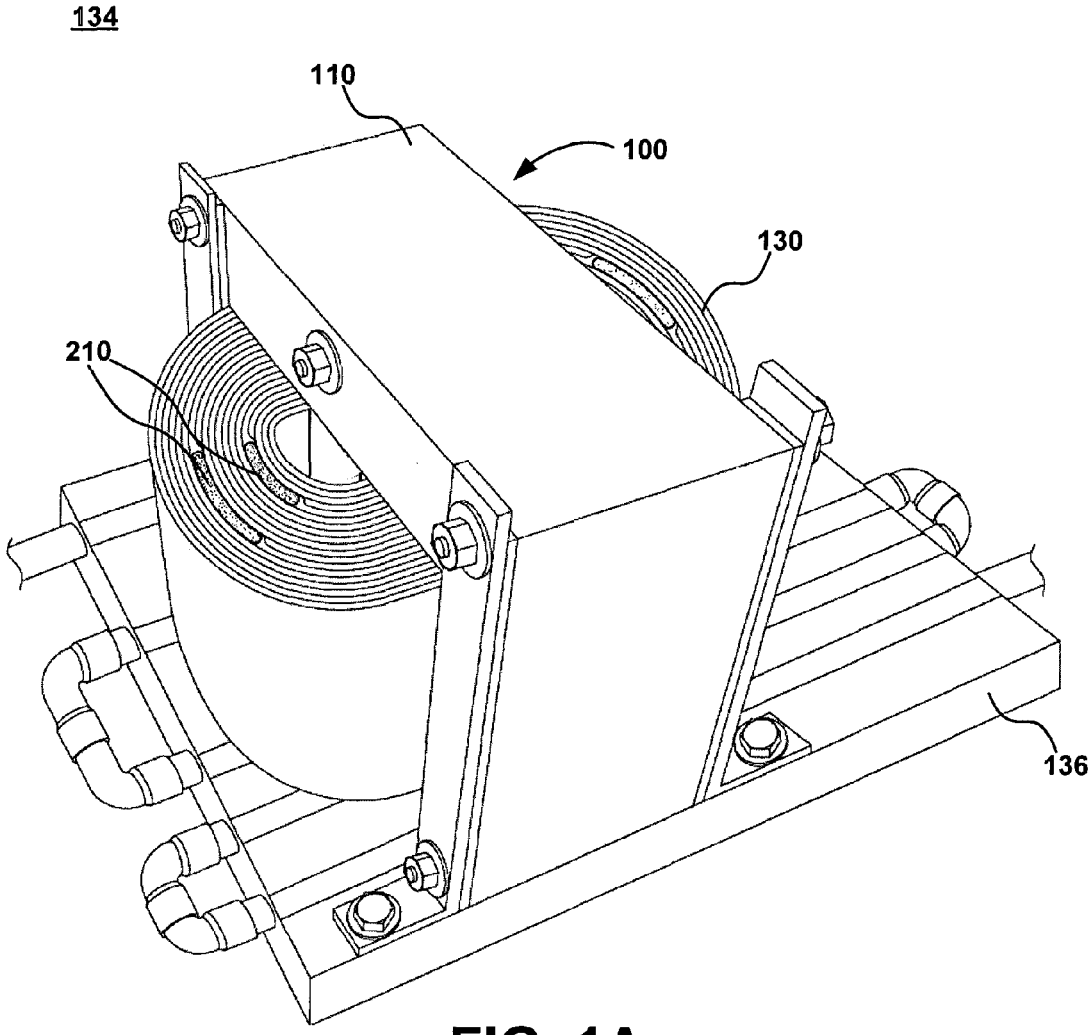
FIG. 1A is a perspective view of an embodiment of a cooled high-power vehicle inductor.
Figure 1B:
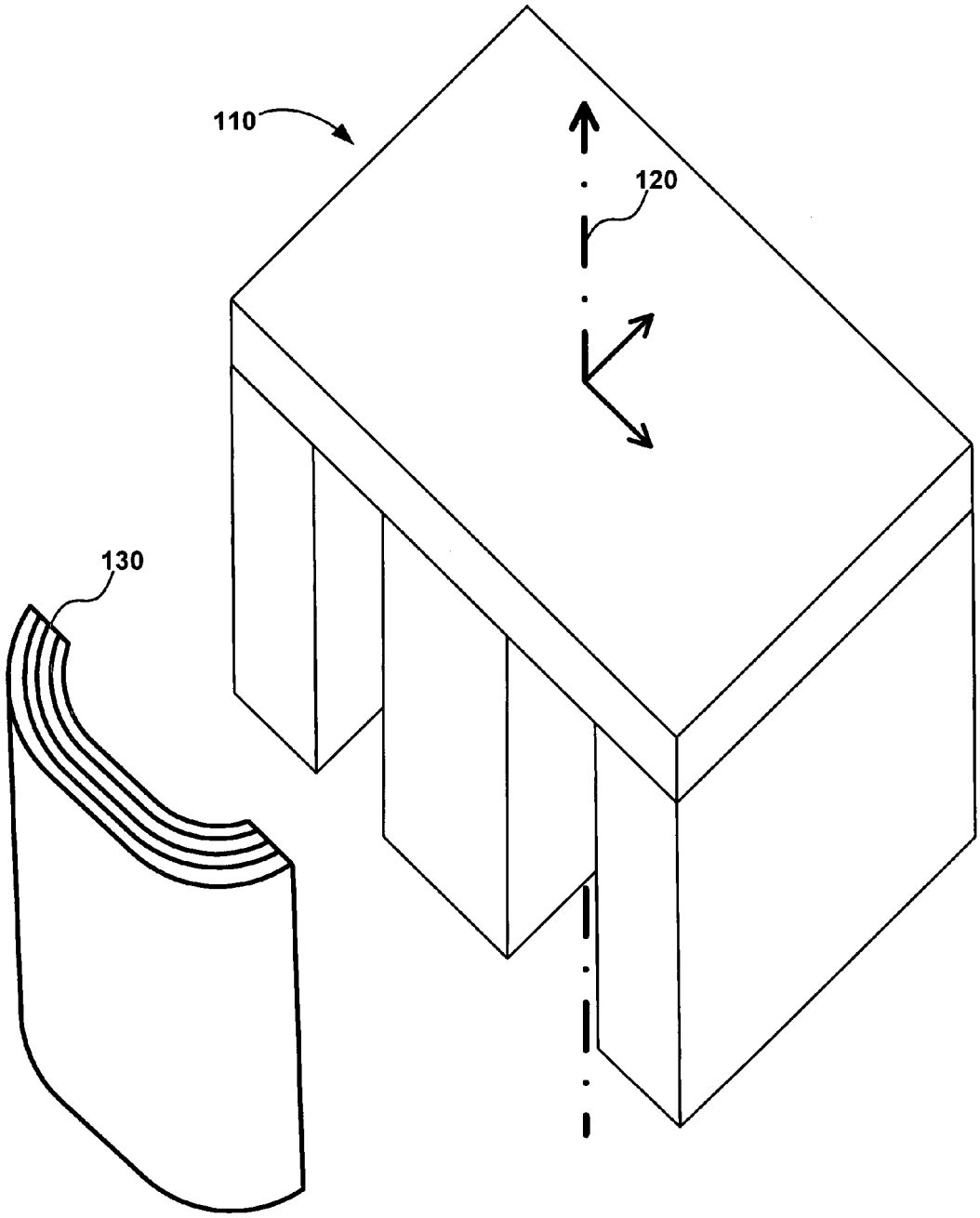
FIG. 1B is a perspective view of an embodiment of a cooled high-power vehicle inductor core and a central axis of the inductor core of FIG. 1A.

Referring to FIG. 1B, the inductor 100 includes a ferromagnetic inductor core 110 with a central axis 120. Inductor windings 130 including flat, flexible sheets, foils, or wire are wrapped in a well-known manner around the inductor core 110. In alternative embodiments, the inductor windings 130 have different configurations than illustrated (e.g., wire, foil). Alternately, inductor 100 may be similarly created in a modular fashion by winding the windings 130 around a bobbin or other forming tool. When the windings are complete, the windings, along with any inserts or passages, may then be removed from the bobbin, to later be installed on inductor core 110. Additionally, it is understood that the windings are electrically insulated from each other, and may be laminated, varnished or otherwise coated.

Referring to FIGS. 1A-3, a system 134 for cooling the high-power inductor 100 includes an external cooling assembly (e.g., external heat sink) 136 and one more heat transfer inserts 210 disposed in heat transfer paths or gaps 140 in the high-power inductor 100. As used herein the "heat transfer insert" is an insert to perform one or more of the following: a) to create the heat transfer path/gap 140, b) to maintain the form of heat transfer path/gap 140, and/or c) to transfer heat away from the inductor windings 130 (150, 160).

The nature of the external cooling assembly 136 will vary with the type of heat transfer insert 210 used or vis versa. For example, if the heat transfer insert(s) 210 cools the high-power inductor 100 by circulating a heat transfer fluid (e.g., air, water, coolant fluid) through the heat transfer paths 140 in the high-power inductor 100, the external cooling assembly 136 will include one or more pumps or fans to impart the pressure to move the heat transfer fluid, one or more conduits that the heat transfer fluid flows through to and from the heat transfer insert(s) 210, and a cooling member/source (e.g., refrigeration unit, radiator, etc.) to cool (remove heat from) the heat transfer fluid.

As another example, if the heat transfer insert(s) 210 cools the high-power conductor by functioning as a solid heat sink, the external cooling assembly 136 may include a heat sink or cooling plate (as illustrated), which the heat transfer insert(s) 210 is thermally coupled, to cool the high-power inductor 100. As illustrated, the cooling plate includes a mechanism for cooling the heat sink/cooling plate such as, but not limited to, one or more pumps (not shown), one or more conduits 138 that heat transfer fluid flows through, and an external vehicle cooling source (e.g., vehicle radiator, refrigeration unit, etc.) to cool the heat transfer fluid and/or to chill the heat sink/cooling plate. The greater the thermal gradient between the heat transfer unit 210 and external cooling assembly 136, the greater the thermal flow. Although the vehicle cooling source may be provided by the vehicle for dedicated inductor cooling or even integrated into a modular unit, it is preferable that the cooled inductor reuse existing cooling systems on the vehicle as this may only require a cooling system plumbing change and further reduce cost.

As discussed above it is desirable to create the heat transfer path, space, or gap 140 between a first series of windings 150 and a second series of windings 160 to allow heat-transfer/cooling there through via the heat transfer insert(s) 210. According to one embodiment, in a method of manufacturing cooled high-power vehicle inductor 100, an internal heat transfer path may be created by winding the first series of windings 150 around a core (e.g., bobbin, inductor core, tool, etc.), providing heat transfer insert(s) 210 at locations along an outer perimeter of the first series of windings 150, and then winding a second series of windings 160 over the heat transfer insert(s) 210 so that an inner perimeter of the second series of windings 160 abuts the heat transfer insert(s) 210 (i.e., the heat transfer insert(s) 210 are sandwiched between the first series of windings 150 and the second series of windings 160 to form gap(s) 140). Although only one cooling layer is discussed here, it is understood that the cooled inductor 100 may include two or more cooling layers, i.e., having a third, fourth, etc. series of windings. Additionally, various alternate configurations will be discussed below.

Figure 3:
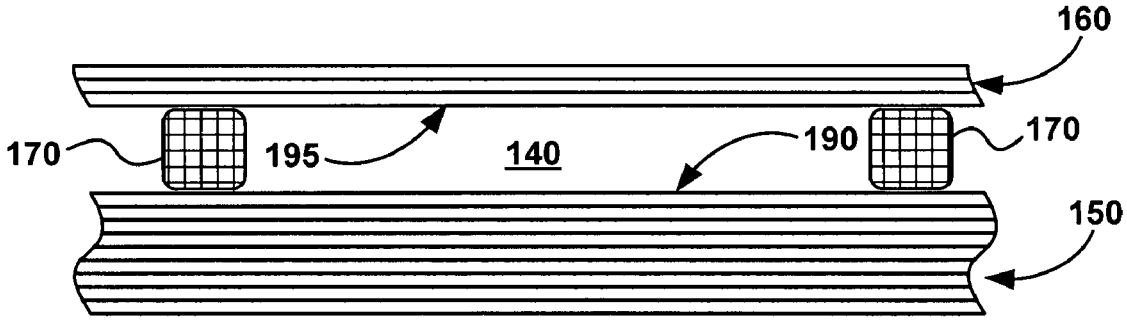
FIG. 3 is a cross sectional view of an embodiment of a first series of inductor windings and a second series of inductor windings spaced apart with elongated spacers disposed between the first series of inductor windings and a second series of inductor windings.

Referring to FIG. 3, shown is a cross sectional view of the build-up of an embodiment. In particular, gap 140 is created by winding the first series of windings 150 around a core (not shown), providing spacers 170 spaced at predetermined locations/distances along an outer perimeter 190 of the first series of windings 150, and then winding a second series of windings 160 over the spacers 170 so that an inner perimeter 195 of the second series of windings 160 abuts the spacers 170 (i.e., the spacers 170 are sandwiched between the first series of windings 150 and the second series of windings 160 to form gap(s) 140). Gap(s) 140 may form a heat transfer path by permitting a heat exchanging medium, such as forced air, to pass between the windings.

In the embodiment shown, the spacers 170 are square cross sectional elongated rods made of or covered with an electrically insulating material. According to one preferred embodiment, the spacers 170 are made of a ceramic material (e.g., "dog bones"). The spacers 170 perform a spacing function to assist in forming the gaps 140. In alternative embodiments, the spacers 170 have one or more different configurations (e.g., elongated oval cross-sectional members, See e.g., FIG. 9). These alternate configurations, having curved edges, may provide added protection against the spacer cutting into the windings or otherwise disturbing the insulating layer between the windings. In alternative embodiments, the spacers 170 may also have one or more additional functions such as, but not limited to, transferring heat away from the inductor windings.

Figure 4:
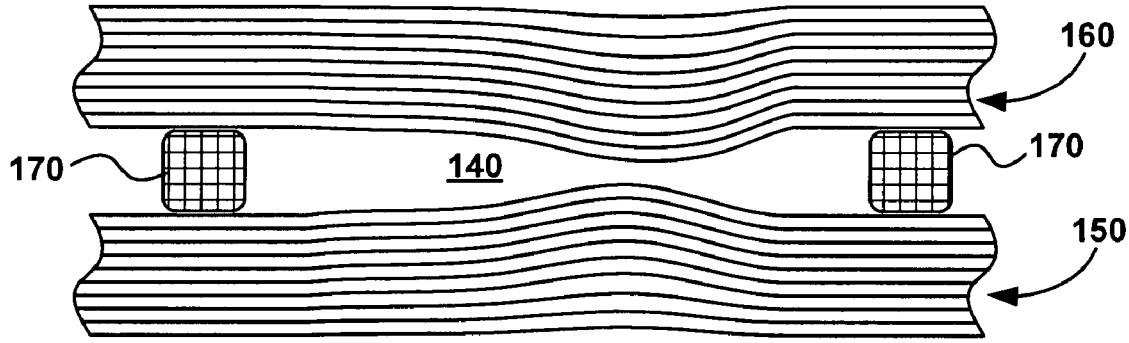
FIG. 4 is a cross-sectional view similar to FIG. 3, and illustrates the collapse of the first series of inductor windings and the second series of inductor into the unsupported space created by the elongated spacers disposed between the first series of inductor windings and a second series of inductor windings.

In certain circumstances, for example due to lack of support, gap(s) 140 created in the winding process may collapse in one or more locations. Shown in FIG. 4 is a cross-sectional view similar to FIG. 3, that illustrates the collapse of the first series of inductor windings 150 and the second series of inductor windings 160 into the space 140 created by the elongated "dog-bone" spacers disposed between the first and the second series of inductor windings 150, 160. Although said "collapse" might not completely close gap(s) 140, the obstruction may result reduced flow and/or cooling performance.

Figure 5:
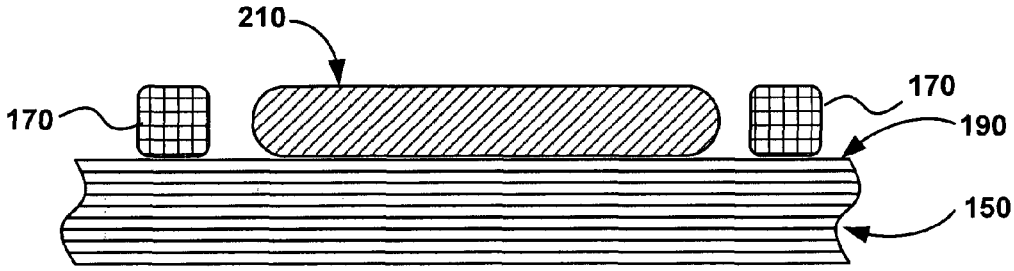
FIG. 5 is a cross sectional view of an embodiment of a first series of inductor windings with elongated spacers, and a heat transfer insert there between, disposed along an outer perimeter of the first series of inductor windings.
Figure 6:
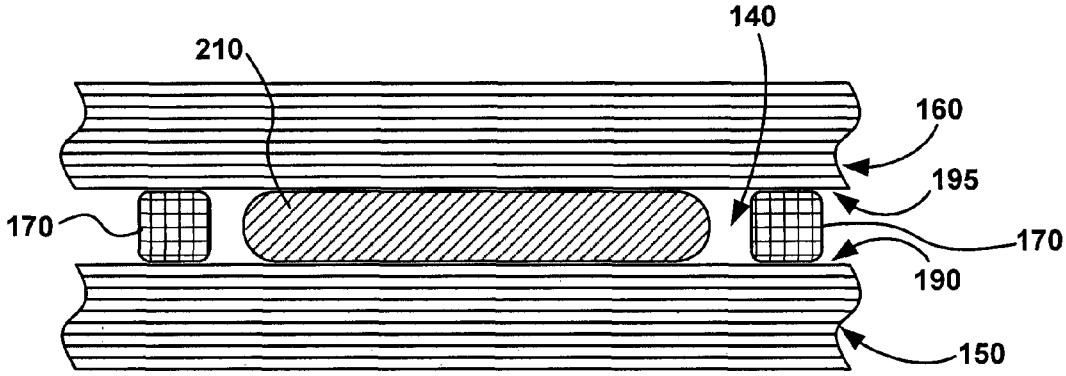
FIG. 6 is a cross sectional view of an embodiment of a first series of inductor windings, a second series of inductor windings, and elongated spacers and a heat transfer insert sandwiched between the first series of inductor windings and the second series of inductor windings.
Figure 7:
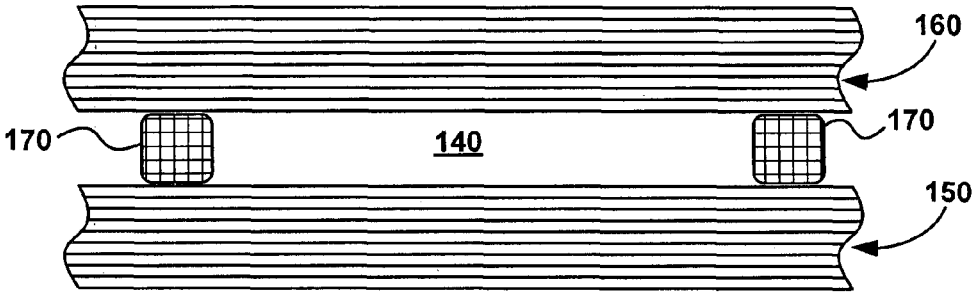
FIG. 7 is a cross sectional view similar to FIG. 6, but with the heat transfer insert shown removed from between the first series of inductor windings and the second series of inductor windings.

Accordingly, in the above method of manufacturing a cooled high-power vehicle inductor and with reference to FIGS. 5-7, the process may also include adding a first heat transfer insert(s) 210 between the spacers 170 when the spacers 170 are applied to the outer perimeter of the first or inner series of windings 150 (FIG. 5). By including insert 210 during winding, gap 140 is formed to a desired shape and clearance (FIG. 6). Once gap 140 has been formed by insert 210, insert 210 may be removed (FIG. 7). Here, first heat transfer insert(s) 210 are intended to be removed after the windings are wound and the inductor is fabricated, however, in alternate embodiments first heat transfer insert(s) 210 may remain in place after inductor fabrication. Alternately, the above process may include adding the first heat transfer insert (s) 210 between the spacers 170 after the completed windings 130 (150, 160) with spacers 170 are applied around the core 110.

Figure 1C:
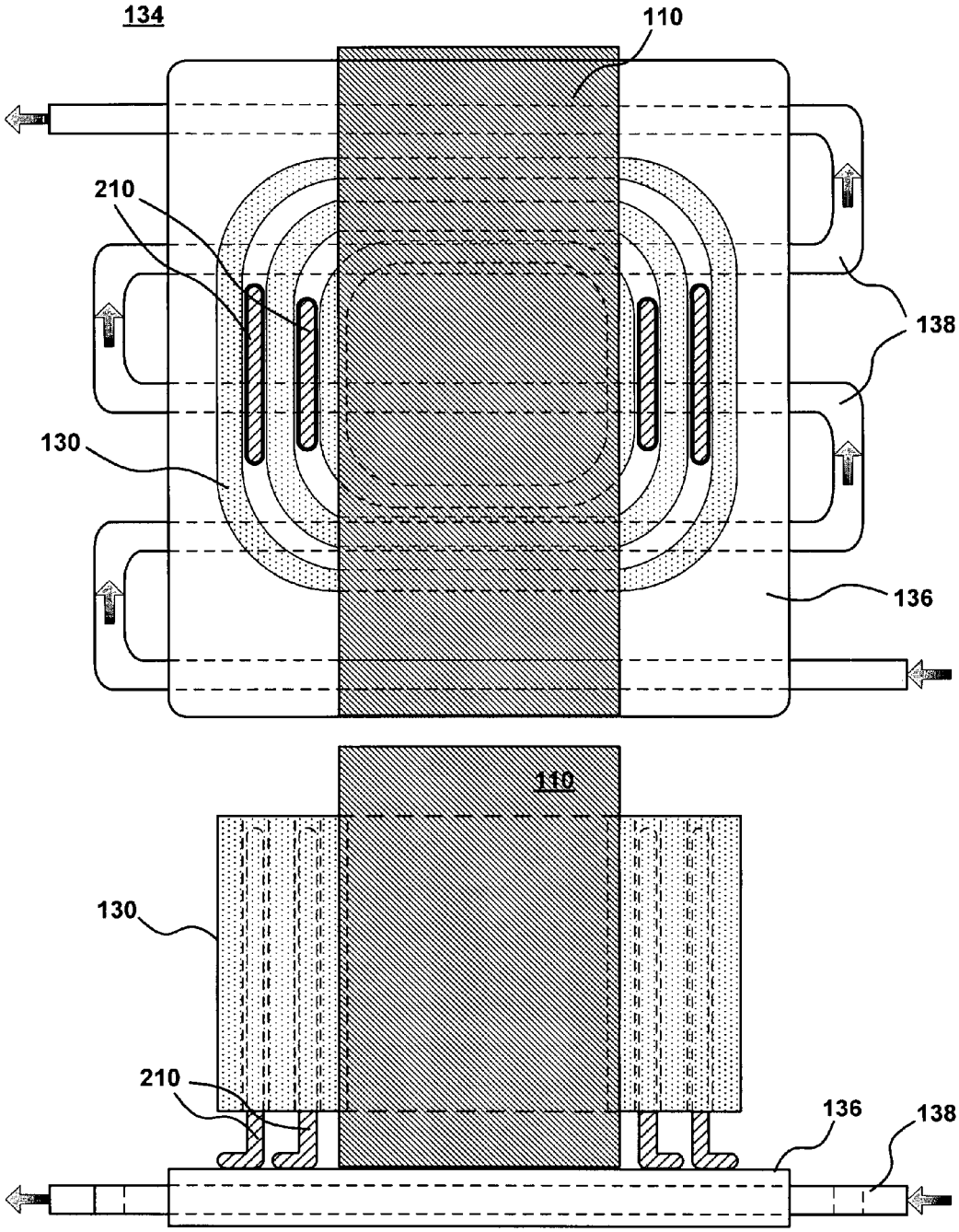
FIG. 1C is a top and side view of an embodiment of the cooled high-power vehicle inductor of FIG. 1A.
Figure 2:
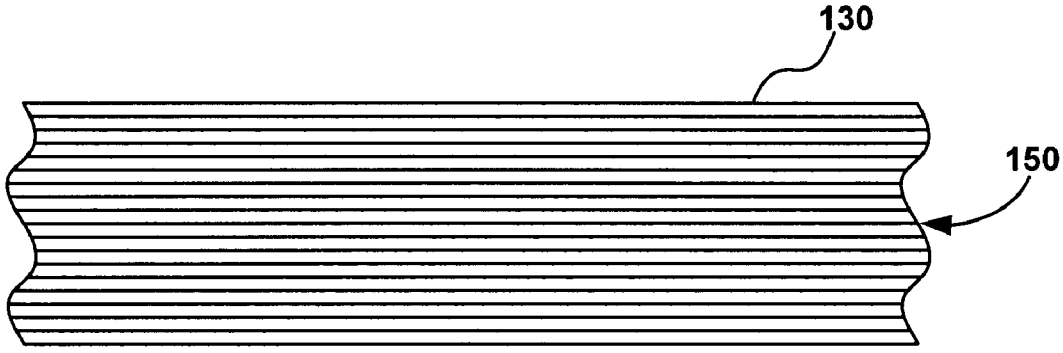
FIG. 2 is a cross sectional view of a series of inductor windings of the cooled high-power vehicle inductor.

As shown in FIG. 1C, the heat transfer insert 210 has a length (reference central axis 120) that is substantially the same as or longer than the length of the spacers 170. Also, as shown in FIG. 6, heat transfer insert 210 has a width (reference the span between spacers 170) that is much wider than the width of the spacers 170. For example, in the embodiment shown in FIG. 6, the heat transfer insert 210 has a width that substantially spans the width/distance between the spacers 170. In this way, minimal area between the first and second series of windings 150, 160 is used for support and can be primarily used for cooling. Also, although illustrated as having vacancies between spacers 170 and insert 210, insert 210 may run flush with spacers 140.

Figure 8:
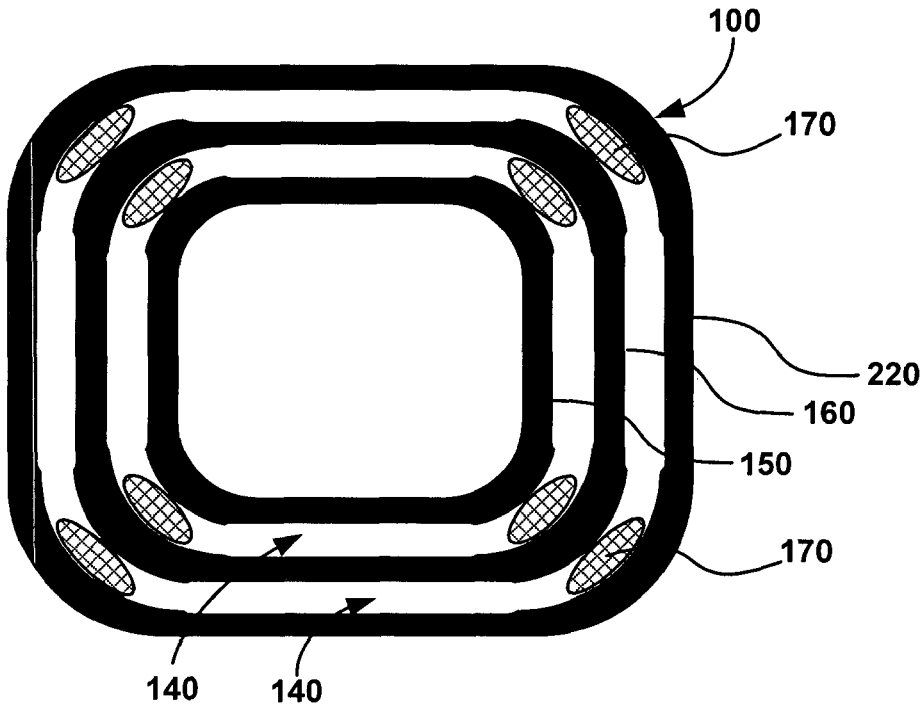
FIG. 8 is a cross sectional view of an embodiment of a cooled inductor, and shows multiple series of inductor windings with spacers sandwiched between an outer perimeter of an inner series of inductor windings and an inner perimeter of an outer series of inductor windings to form spaces for the provision of heat transfer inserts there though.
Figure 9:
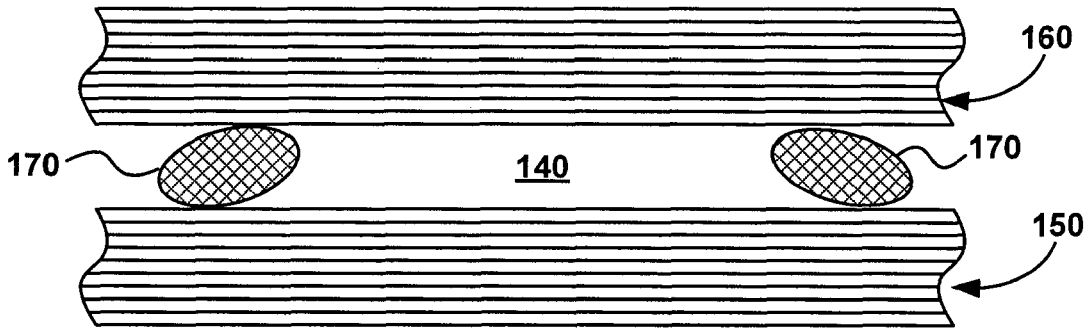
FIG. 9 is a cross sectional view of an embodiment of a first series of inductor windings and a second series of inductor windings spaced apart with elongated spacers disposed between the first series of inductor windings and a second series of inductor windings.

FIG. 8 is a cross sectional view of the above embodiment of cooled inductor 100, and shows multiple series of inductor windings with spacers 170 between concentric inductor winding series 150, 160, 220 to form gaps 140. As shown in FIGS. 8 and 9, spacers 170 may have alternative configurations (e.g., elongated oval cross-sectional spacers) and/or be disposed in alternative positions, changing the configuration and width of the gaps 140 formed between the spacers 170 and concentric inductor winding series 150, 160, 220. In the embodiment shown, the gaps 140 may be created with or without the heat transfer insert 210.

Figure 10:
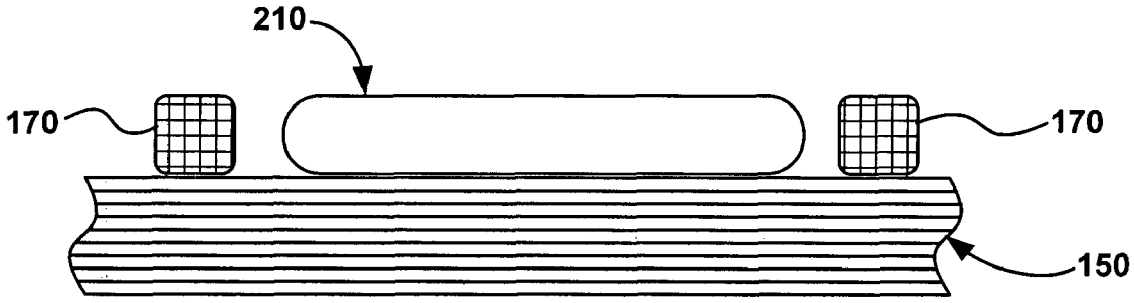
FIG. 10 is a cross sectional view of an embodiment of a first series of inductor windings with elongated spacers, and a heat transfer insert there between, disposed along an outer perimeter of the first series of inductor windings.
Figure 11:
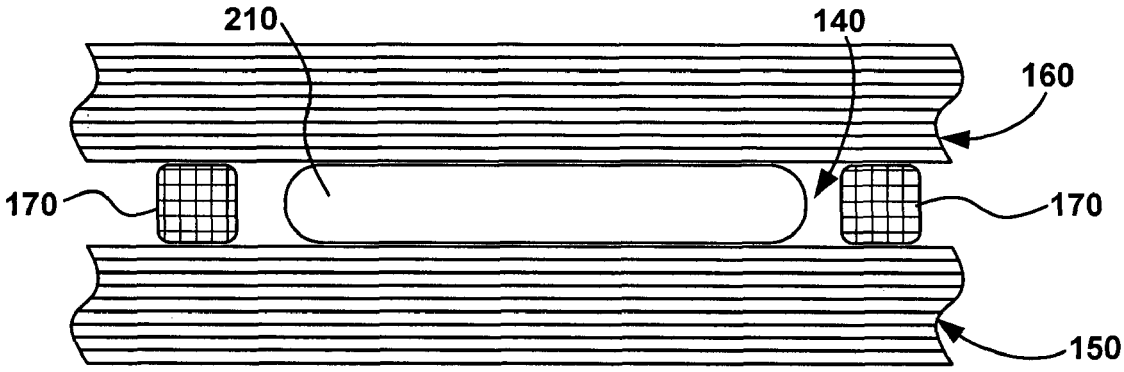
FIG. 11 is a cross sectional view of an embodiment of a first series of inductor windings, a second series of inductor windings, and elongated spacers and a heat transfer insert sandwiched between the first series of inductor windings and the second series of inductor windings.

FIGS. 10 and 11 illustrate creation of the gap(s) 140 with the assistance of the heat transfer insert(s) 210 and the subsequent filling gap(s) 140 with a second heat transfer insert (s). The heat transfer inserts described herein are made of suitable heat transfer materials (e.g., aluminum, copper) with high thermal conductivities, and are electrically insulated from the inductor windings 130 (150, 160, 220).

In the embodiment shown, once the heat transfer path/gap 140 is created using the first heat transfer insert 210 (shown in FIGS. 10 and 11), the first heat transfer insert 210 is removed, and a separate, second heat transfer insert (e.g., heat transfer insert 230 (FIG. 12), heat transfer insert 240 (FIG. 13)) with a heat removal mechanism is disposed in the gap 140 for transferring heat away from the inductor windings 150, 160. As above, second heat transfer insert 230, 240 may occupy most of all of gap 140. Additionally, it is preferable that the second heat transfer insert 230, 240 be sufficiently thinner than the gap formed by first heat transfer insert 210 and supported by spacers 170 so as to facilitate insertion without causing damage to the surrounding windings 150, 160 upon insertion.

Figure 12:
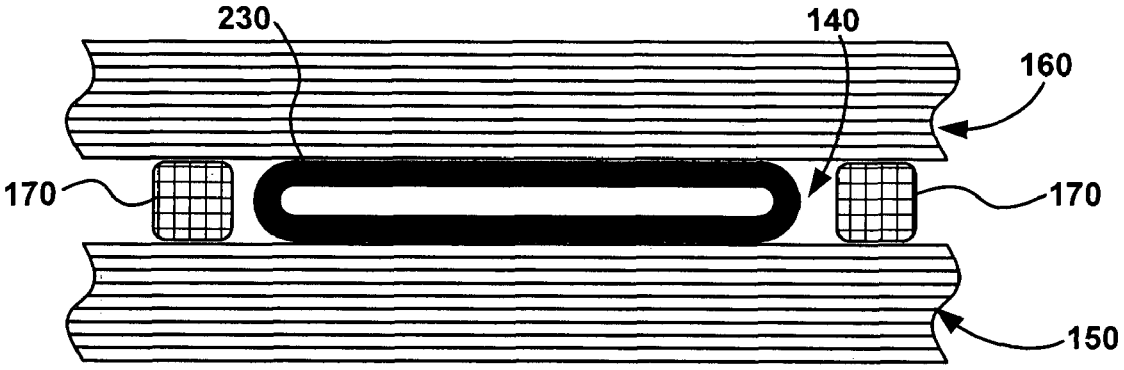
FIG. 12 is a cross sectional view similar to FIG. 11 and shows an alternative embodiment of a heat transfer insert.
Figure 14A:
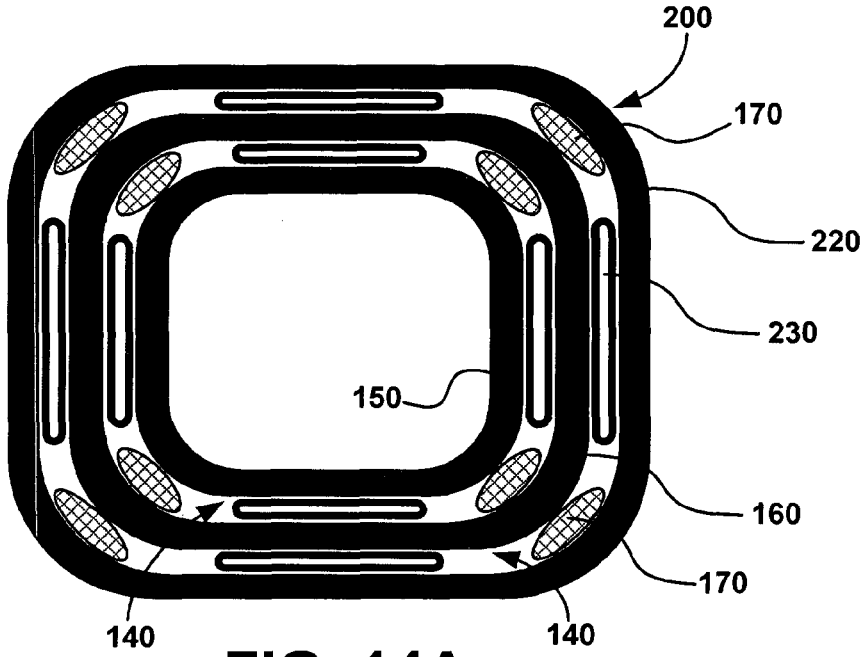
FIG. 14A is a cross sectional view of another embodiment of a cooled inductor, and shows multiple series of inductor windings with spacers and hollow heat transfer inserts sandwiched between an outer perimeter of an inner series of inductor windings and an inner perimeter of an outer series of inductor windings to allow heat transfer or cooling in the inductor.

The heat transfer insert 230 shown in FIG. 12 includes a single, wide lumen that extends the longitudinal length of the heat transfer insert 230, allowing for the flow of a heat transfer fluid (e.g., air, liquid coolant) through this heat transfer mechanism to transfer heat away from the inductor windings 150, 160 and cool the high-power inductor 200 (FIG. 14A). This embodiment is preferred in a system where the cooling fluid enters one side of the windings and exits the other side of the windings. For example, where the cooling fluid is forced air, the air may enter from the bottom of the inductor 200

(FIG. 14A) pass through heat transfer insert 230, exchanging heat with inductor 200, and be collected or ejected from the top of the windings.

Figure 13:
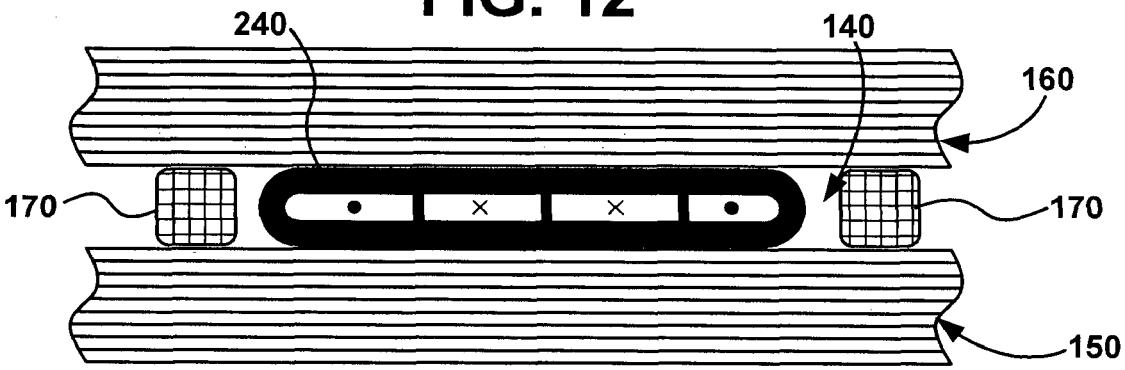
FIG. 13 is a cross sectional view similar to FIG. 11 and shows an another embodiment of a heat transfer insert.

The heat transfer insert 240 shown in FIG. 13 includes multiple lumens extending the longitudinal length of the heat transfer insert 240, allowing for the flow of one or more heat transfer fluids (e.g., air, liquid coolant) through this heat transfer mechanism to transfer heat away from the inductor windings 150, 160 and to cool the high-power inductor 200 (FIG. 14A). This embodiment is preferred in a system where the cooling fluid enters one side of the windings and exits the same side of the windings.

For example, where the cooling fluid is vehicle coolant, the coolant may enter the outer channels of insert 240 from a cold plate underneath inductor 200, exchange heat with inductor 200, and return to the cold plate via the inner channels of insert 240. In this case, the multiple lumens may be joined to form a return path for the coolant.

Alternately, where the flow of the one or more heat transfer fluids is unidirectional (i.e., entering one side of the windings and exiting the other side of the windings), the embodiment illustrated in FIG. 13 may provide enhanced heat exchange since the boundaries of the one or more lumens may serve to increase the heat exchanging surface and function as cooling fins.

Figure 14B:
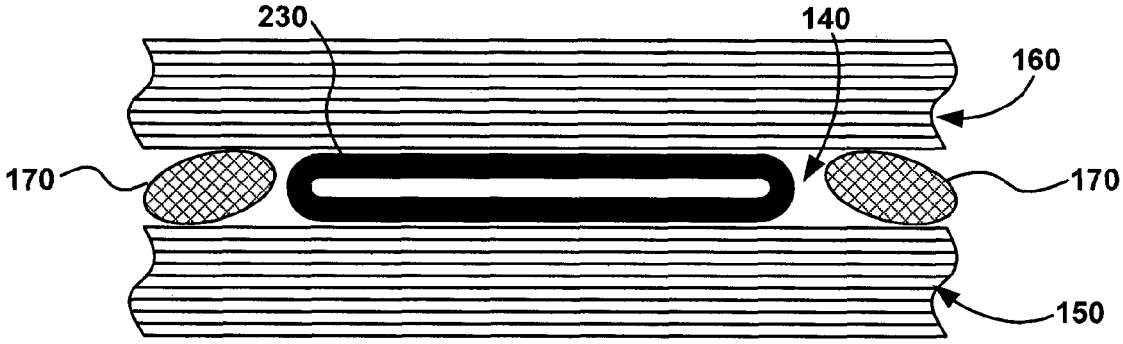
FIG. 14B is a cross sectional view of an embodiment of a first series of inductor windings, a second series of inductor windings, and elongated spacers and a hollow heat transfer insert sandwiched between the first series of inductor windings and the second series of inductor windings.

With reference to FIGS. 14A and 14B, an embodiment of a cooled high-power vehicle inductor 200 is shown with spacers 170 and heat transfer insert 230 forming gaps 140 between concentric inductor winding series 150, 160, 220. In this exemplary illustration, heat transfer insert 230 forms a conduit for a cooling fluid to exchange and carry heat from inductor 200. As illustrated, cooled high-power vehicle inductor 200 may include multiple heat transfer inserts 230 and multiple layers of internal cooling between winding layers 150, 160, 220. As discussed above, the cooled high-power vehicle inductor 200 may also interface with an external cooling assembly (e.g., a vehicle cooling supply) as appropriate to the type of cooling mechanism used.

Figure 15A:
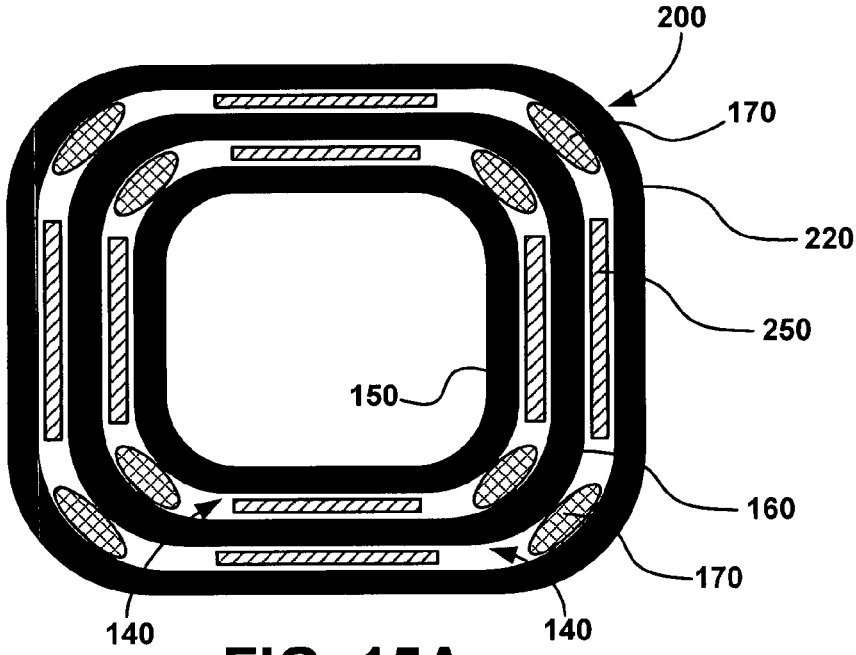
FIG. 15A is a cross sectional view of another embodiment of a cooled inductor, and shows multiple series of inductor windings with spacers and solid heat transfer inserts sandwiched between an outer perimeter of an inner series of inductor windings and an inner perimeter of an outer series of inductor windings to allow heat transfer or cooling in the inductor.
Figure 15B:
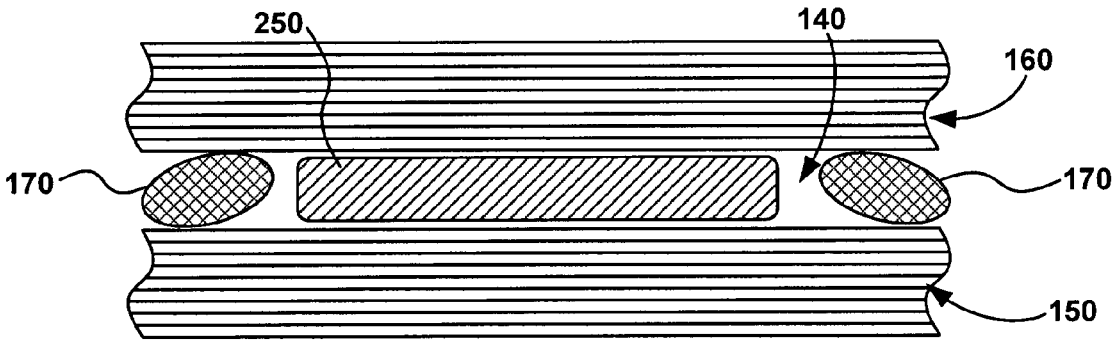
FIG. 15B is a cross sectional view of an embodiment of a first series of inductor windings, a second series of inductor windings, and elongated spacers and a solid heat transfer insert sandwiched between the first series of inductor windings and the second series of inductor windings.

With reference to FIGS. 15A and 15B, an embodiment of a cooled high-power vehicle inductor 200 is shown with spacers 170 and heat transfer insert 250 forming gaps 140 between concentric inductor winding series 150, 160, 220. In this exemplary illustration, heat transfer insert 250 forms a solid thermal conduit to carry heat from inductor 200. Here, heat transfer insert 250 is preferably made of a material with high thermal conductivity such as copper or aluminum, and is electrically isolated from the windings. In addition, heat transfer insert 250 is thermally coupled to a heat sink, cold plate or other external cooling mechanism (not shown). As illustrated, heat transfer insert 250 is inserted into the windings after gap 140 is formed by a first heat transfer insert. However, according to one embodiment, heat transfer insert 250 may also be inserted initially (during winding) with or without spacers 170.

Heat transfer insert 250 is not limited to any single geometry, however, insert 250 may be constructed at a low cost from a single bar of metal bent at a right angle, wherein one portion is merged between the inductor windings and the other portion lies flat against an external cooling assembly (see for reference, FIGS. 1A, 1C). Alternately, heat transfer insert 250 may have a geometry such that the portion of its surface area that interfaces with the external cooling assembly is spread out or otherwise increased to maximize thermal conductivity.

As illustrated, cooled high-power vehicle inductor 200 may also include multiple heat transfer inserts 250 and multiple layers of internal cooling between winding layers 150, 160 and 220. Additionally, according to one embodiment, heat transfer insert 250 and the external cooling mechanism may also include a coating of thermally conductive material between the two so as to improve the thermal conductivity of their interface. An example of the thermally conductively material includes thermal grease (also called thermal compound, heat paste, thermal paste, or heat sink compound).

Similarly, as heat transfer inserts 230, 240, 250 are preferably "thinner" than gap 140, heat transfer inserts 230, 240, 250 may also preferably include a thermally conductive filling. As discussed above, thermally conductive coatings may provide an improved thermal coupling and are known in the art. Additionally, besides improving thermal exchange between the windings and the insert, a thermally conductive filling having structural or dampening properties may be selected to serve a dual role of securing the insert against vibrations, which are commonly seen in a vehicle application.

One advantage of utilizing a first heat transfer insert to form gap 140 and a second heat transfer insert to provide the cooling mechanism to the inductor 200, is that it allows a manufacturer to fabricate a single cooled inductor, off of a single tool, yet retain the flexibility for the inductor 200 to be used in multiple configurations. For example, a single inductor 200 may be manufactured and integrated in heavy duty HEV high power DC-DC converter. Depending on which external cooling source is available/provided by the HEV, the unit may alternately receive heat transfer inserts 230, 240, 250 for example.

Moreover, a single cooled inductor may be configured for different performance specifications. For example, depending on the performance requirements of the vehicle, a single high power DC-DC converter, based on inductor 200, may incorporate heat transfer insert 250 in a passively cooled configuration, or may incorporate heat transfer inserts 230, 240 for active cooling (e.g., using air or liquid coolant).

This flexibility is beneficial to the component manufacturer because a single component, based on heavy duty inductor 200, may be built for multiple applications. This flexibility is beneficial to the hybrid/EV integrator since a single component, based on heavy duty inductor 200, may be stocked in advance and configured as required upon integration, thus reducing long lead times and/or larger inventories. This flexibility may also be realized by the vehicle customer in the form of reduced cost (derived from lower cost associated with bulk components and/or from internal fabrication) and reduced delivery time.

Figure 16:
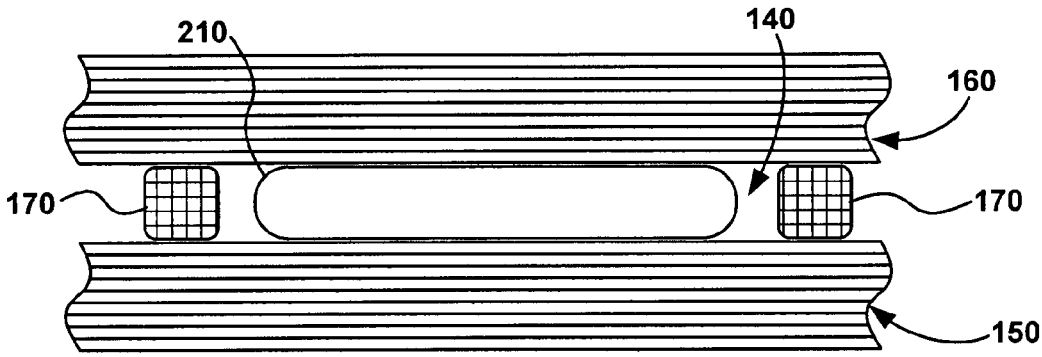
FIG. 16 is a cross sectional view of an embodiment of a first series of inductor windings, a second series of inductor windings, and elongated spacers and a hollow heat transfer insert sandwiched between the first series of inductor windings and the second series of inductor windings.
Figure 17:
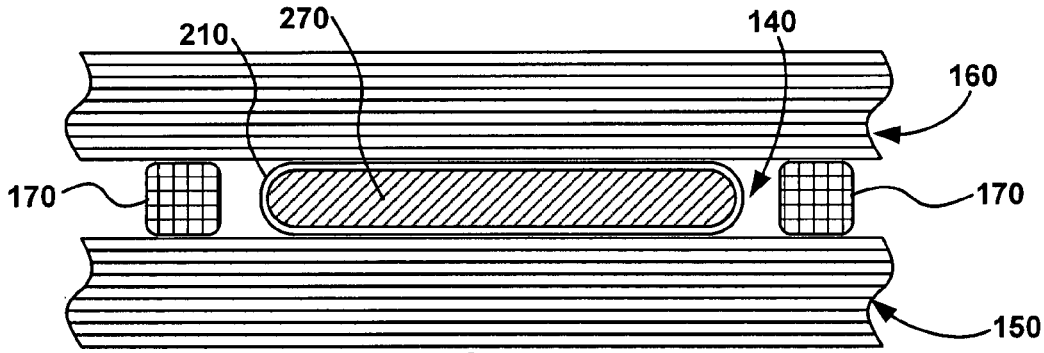
FIG. 17 is a cross sectional view similar to FIG. 16 and shows a second heat transfer insert slidably inserted in the first heat transfer insert.
Figure 18:
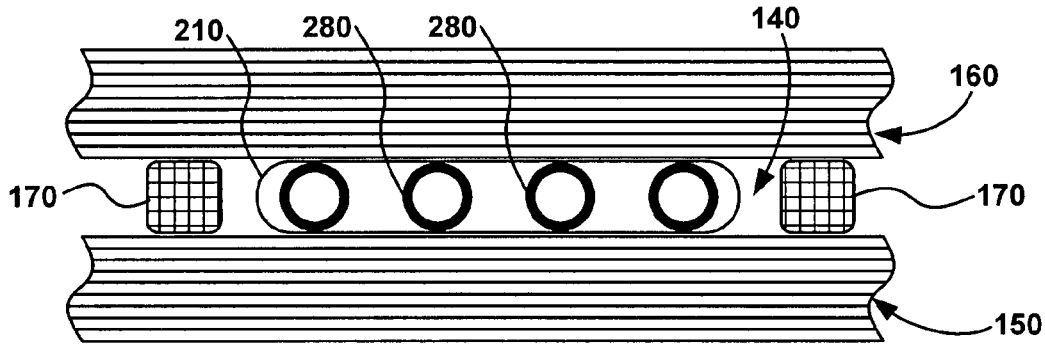
FIG. 18 is a cross sectional view similar to FIG. 17 and shows a multiple tubes slidably inserted in the first heat transfer insert.

As shown in FIGS. 16, 17, and 18, the heat transfer inserts 210 used to form the gaps 140 may be hollow and remain in place. FIG. 16 shows an embodiment of the hollow heat transfer insert 210. In this embodiment, the heat transfer insert 210 may function similar to heat transfer insert 230 described above (see FIGS. 12, 14A, and 14B) and allow fluid flow there through to remove heat from the inductor windings 150, 160, and 220. Alternatively, the heat transfer insert 210 may function as a guide or sheath that one or more heat transfer mechanisms may be slidably inserted therein.

For example, FIG. 17 illustrates an embodiment of a heat transfer mechanism in the form of a solid heat sink member 270 that is slidably inserted into the positioned heat transfer insert 210. Both the solid heat sink member 270 and the heat transfer insert 210 are made of a highly thermally conductive material (e.g., aluminum, copper) that allows heat to be transferred away from the inductor windings 150, 160, 220. Functionally, the combination of heat transfer insert 210 and solid heat sink member 270 is similar to heat transfer insert 250 shown in FIGS. 15A and 15B, passively conducting heat from within the inductor. The solid heat sink members 270 are preferably thermally coupled to a heat sink (e.g., chilled heat sink plate; see e.g., FIGS. 1A, 1C) for removing heat from the high-power inductor 200.

FIG. 18 illustrates another embodiment of a heat transfer mechanism in the form of multiple lumens or tubes 280 (e.g., copper or aluminum tubes) that are slidably inserted (separately or collectively) into the positioned heat transfer insert 210. In alternative embodiments, the lumens/tubes 280 may be part of a heat transfer manifold, or the lumens/tubes 280 are integral with or fixed within the heat transfer insert 210. Both the lumens/tubes 280 and the heat transfer insert 210 are made of a thermally conductive material (e.g., aluminum, copper) that allows heat to be transferred away from the inductor windings 150, 160. In a manner similar to that described above with respect to FIG. 13, fluid flows through the lumens/tubes 280 to remove heat from the inductor windings 150, 160.

In an alternative embodiment, instead of the hollow heat transfer insert 210 remaining in place after the heat transfer mechanism(s) 270, 280 are inserted/slid into position, the hollow heat transfer insert 210 is removed after the heat transfer mechanism(s) 270, 280 are inserted/slid into position. In this embodiment, after the heat transfer mechanism(s) 270, 280 are inserted/slid into position using the hollow heat transfer insert 210 as a guide, the hollow heat transfer insert 210 is pulled out of the gap 140, over the heat transfer mechanism(s) 270, 280 (i.e., heat transfer mechanism(s) 270, 280 is/are used as a guide to remove the hollow heat transfer insert 210 from the gaps 140), leaving the heat transfer mechanism (s) 270, 280 in position in the gaps 140. When hollow heat transfer insert 210 is removed, any volume in gaps 140 between the remaining heat transfer mechanism(s) 270, 280 and the windings may be filled as described above.

Figure 19A:
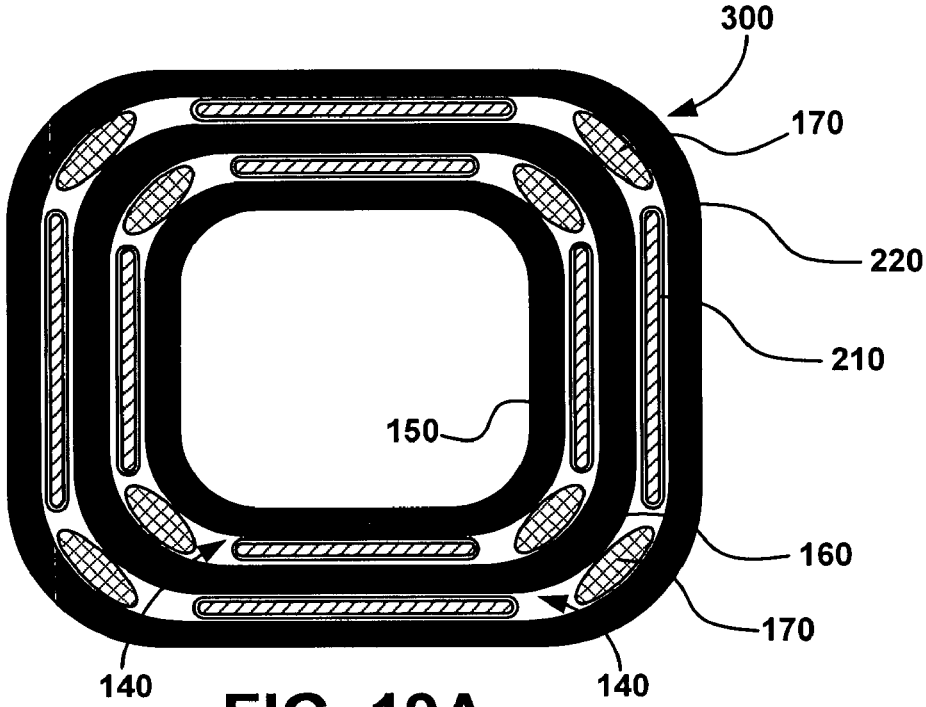
FIG. 19A is a cross sectional view similar to FIG. 14A but showing second heat transfer inserts slidably inserted in the first heat transfer inserts.
Figure 19B:
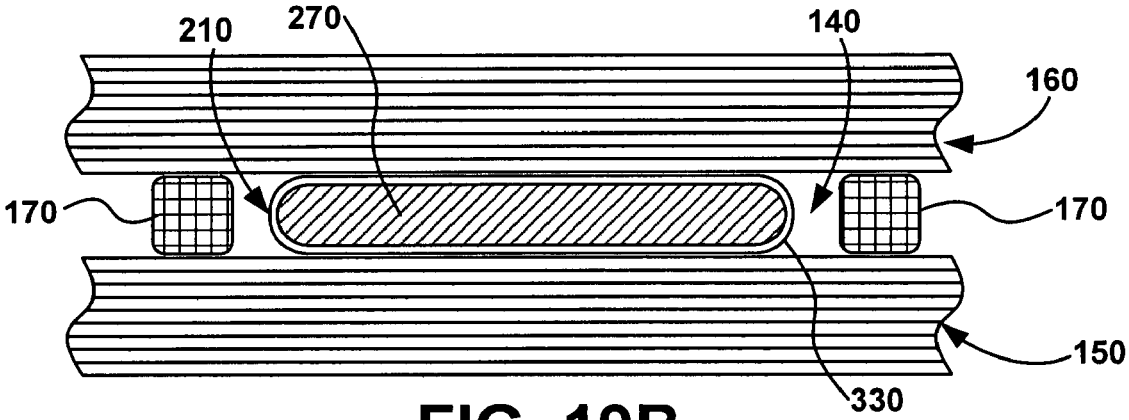
FIG. 19B is a cross sectional view similar to FIG. 14B but showing a second heat transfer insert slidably inserted in the first heat transfer insert.

With reference to FIGS. 19A and 19B, an embodiment of a cooled high-power vehicle inductor 300 is shown with spacers 170 and heat transfer insert 210, here having solid heat sink member 270 slidably inserted within the heat transfer guide/sheath, forming gaps 140 between concentric inductor winding series 150, 160, 220. Both the solid heat sink member 270 and the heat transfer guide/sheath 210 are made of a thermally conductive material that allows heat to be transferred away from the inductor windings 150, 160, 220. Each solid heat sink member 270 is preferably thermally coupled to a heat sink (e.g., chilled heat sink plate, see FIG. 1C) for removing heat from the high-power inductor 300.

Figure 20:
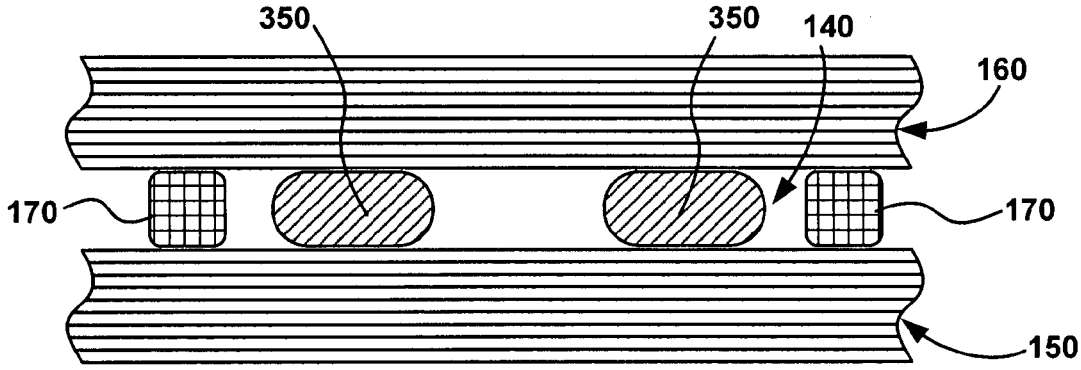
FIG. 20 is a cross sectional view similar to FIG. 6, but shows a pair of heat transfer inserts disposed between the spacers.
Figure 21:
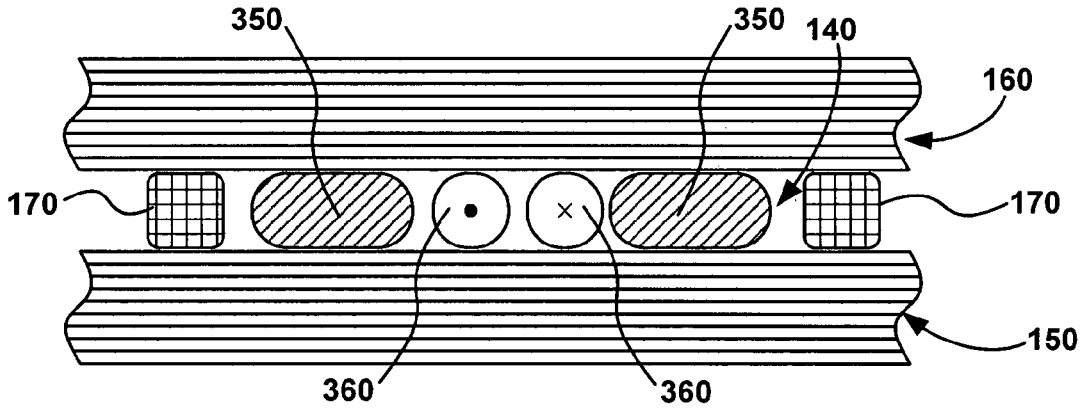
FIG. 21 is a cross sectional view similar to FIG. 20, but shows multiple heat transfer inserts of different cooling mechanisms disposed between the spacers.
Figure 22:
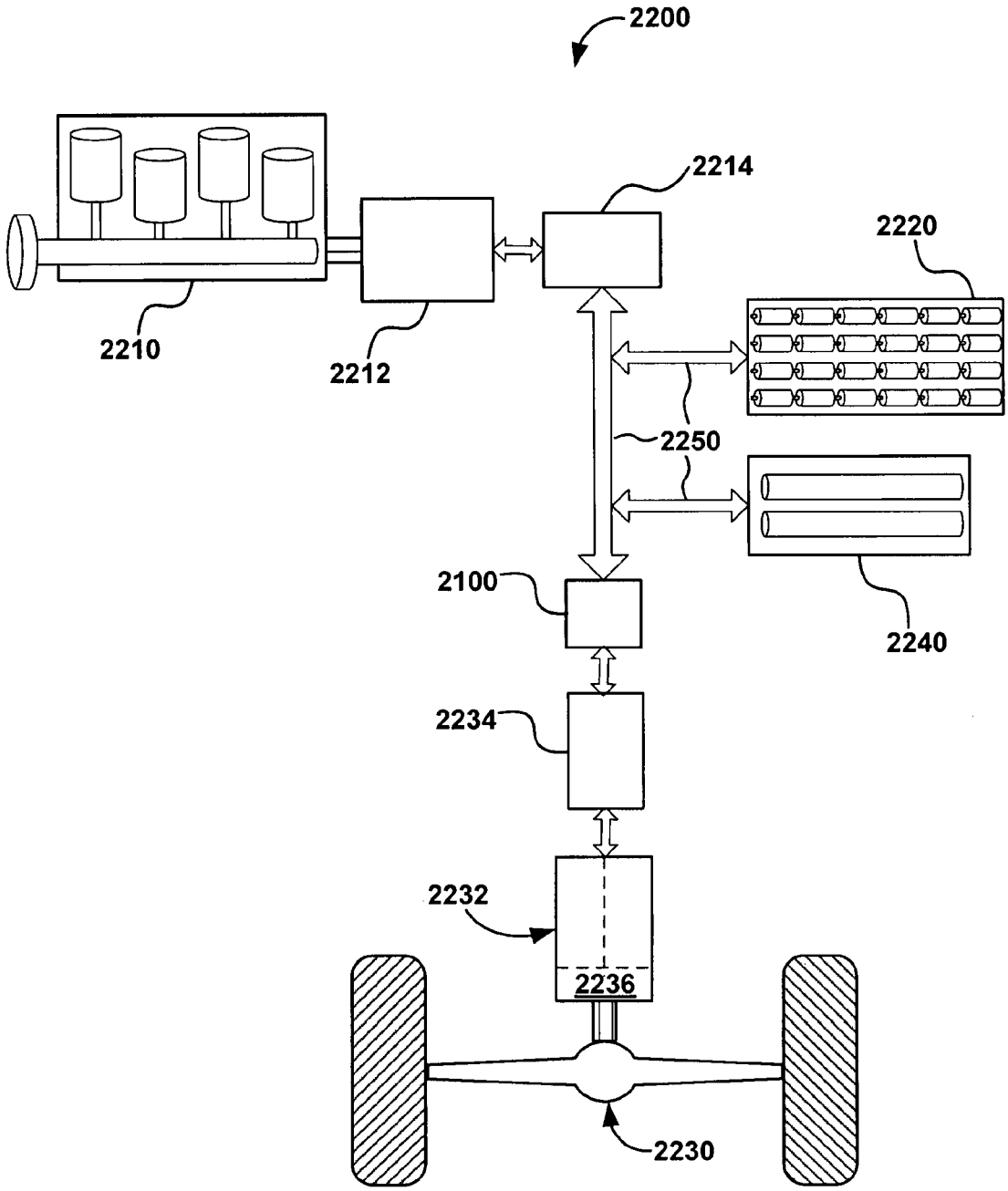
FIG. 22 illustrates an exemplary HEV drive system in a series configuration.

FIGS. 20, 21 show alternative embodiments of the one or more "heat sink" heat transfer inserts 210 that may be used in the cooled high-power vehicle inductor 300. FIG. 20 shows an embodiment of multiple "heat sink" heat transfer inserts in the form of a plurality of solid heat sink members 350 disposed between the spacers 170 in the gap 140. As illustrated, the heat sink members 350 are elongated and have an elliptical cross section similar to the heat sink member 250 described above, except the heat sink members 350 are not as wide as the heat sink members 250. The heat sink members 350 are solid and made of a thermally conductive material (e.g., aluminum, copper) that allows heat to be transferred away from the inductor windings 150, 160. Each solid heat sink member 350 is preferably thermally coupled to a heat sink (e.g., chilled heat sink plate, See FIG. 1C) for removing heat from the high-power inductor 300. Although a pair of heat sink members 350 are shown disposed in the gap 140 between spacers 170 in FIG. 20, in alternative embodiments, other numbers of heat sink members 350 (e.g., 3, 4, etc.) are disposed in the gap 140 between spacers 170.

In a further embodiment, with reference to FIG. 21, in addition to one or more solid heat sink members 350, one or more heat transfer tubes/lumens 360 are disposed in the gap 140 between spacers 170. Heat transfer fluid flows through the tube(s)/lumen(s) 360 (along with heat transferred via the heat sink member 350) to transfer heat away from the inductor windings 150, 160 and cool the high-power inductor 300. In this way, solid heat sink members 350 may passively cool the high power inductor during normal operation with supplemental active cooling as needed, for example during full acceleration or under adverse environmental conditions.

Although this embodiment is illustrated as having a passive solid heat sink member 350 and an active liquid heat transfer tube/lumen 360, it is contemplated that other variations may be used, depending on the needs of the high power inductor and cooling available from the HEV/EV. For example, the cooling assembly may include a combination of solid member passive cooling and active, unidirectional air cooling, wherein pressurized air is released in winding gap 140 when inductor reaches or is expected to reach (i.e., upon applied load) an elevated temperature. Alternately, the cooling assembly may include a plurality of active cooling mechanisms, which provide a high and low level of cooling, for example a refrigerant and forced air cooling. Further variations and refinements are contemplated.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A cooled high-power vehicle inductor, comprising an inductor core including a central axis;

a first series of inductor windings around the central axis of the inductor core, the first series of inductor windings having an outer perimeter;

a second series of inductor windings around the central axis of the inductor core, the second series of inductor windings having an inner perimeter that is substantially outside the outer perimeter of the first series of inductor windings, wherein the second series of inductor windings is electrically coupled to the first series of inductor windings;

at least one heat transfer path disposed between the outer perimeter of the first series of inductor windings and the inner perimeter of the second series of inductor windings;

an interface to an external cooling source;

wherein the at least one heat transfer path comprises a first heat transfer insert made substantially from a thermally conductive material; and, wherein the first heat transfer insert is configured to transfer heat from the cooled high-power vehicle inductor to the external cooling source.

2. The cooled high-power vehicle inductor of claim 1, wherein the first heat transfer insert comprises a solid bar configured to conduct heat.

3. The cooled high-power vehicle inductor of claim 1, wherein the first heat transfer insert comprises an at least partially hollow member configured to move coolant fluid there through.

4. The cooled high-power vehicle inductor of claim 1, wherein the first heat transfer insert comprises an at least partially hollow member configured to receive a second heat transfer insert.

5. A cooled high-power vehicle inductor, comprising an inductor core including a central axis;

a first series of inductor windings around the central axis of the inductor core, the first series of inductor windings having an outer perimeter;

a second series of inductor windings around the central axis of the inductor core, the second series of inductor windings having an inner perimeter that is substantially outside the outer perimeter of the first series of inductor windings, wherein the second series of inductor windings is electrically coupled to the first series of inductor windings;

at least one heat transfer path disposed between the outer perimeter of the first series of inductor windings and the inner perimeter of the second series of inductor windings;

an interface to an external cooling source;

a first spacer disposed between the outer perimeter of the first series of inductor windings and the inner perimeter of the second series of inductor windings;

a second spacer disposed between the outer perimeter of the first series of inductor windings and the inner perimeter of the second series of inductor windings;

wherein the at least one heat transfer path is formed by the first spacer and the second spacer, and the at least one heat transfer path comprises a first heat transfer insert made substantially from a thermally conductive material, the first heat transfer insert located between first spacer and the second spacer; and, wherein the first heat transfer insert is configured to transfer heat from the cooled high-power vehicle inductor to the external cooling source.

6. The cooled high-power vehicle inductor of claim 5, wherein the first heat transfer insert comprises an at least partially hollow member configured to receive a second heat transfer insert.

7. A cooled high-power vehicle inductor, comprising an inductor core including a central axis;

a first series of inductor windings around the central axis of the inductor core, the first series of inductor windings having an outer perimeter;

a second series of inductor windings around the central axis of the inductor core, the second series of inductor windings having an inner perimeter that is substantially outside the outer perimeter of the first series of inductor windings, wherein the second series of inductor windings is electrically coupled to the first series of inductor windings;

at least one heat transfer path disposed between the outer perimeter of the first series of inductor windings and the inner perimeter of the second series of inductor windings;

a first external cooling source interface; and, a second external cooling source interface;

wherein the at least one heat transfer path comprises a first heat transfer insert and a second heat transfer insert, the first and second heat transfer inserts made substantially from a thermally conductive material;

wherein the first heat transfer insert is configured to transfer heat via a first cooling mechanism from the cooled high-power vehicle inductor via the first external cooling source interface; and, wherein the second heat transfer insert is configured to transfer heat via a second cooling mechanism, from the cooled high-power vehicle inductor via the second external cooling source interface.

8. A method of manufacturing a cooled high-power vehicle inductor, the method comprising:

providing a first series of inductor windings around a central axis, the first series of inductor windings having an outer perimeter;

providing a second series of inductor windings around the central axis, the second series of inductor windings having an inner perimeter that is substantially outside the outer perimeter of the first series of inductor windings, wherein the second series of inductor windings is electrically coupled to the first series of inductor windings; and, providing at least one heat transfer path member between the first and the second series of inductor windings, wherein the at least one heat transfer path member is positioned parallel with the central axis, along the outer perimeter of the first series of inductor windings and the inner perimeter of the second series of inductor windings, wherein the at least one heat transfer path member forms a path for heat to be removed from between the first and the second series of windings, providing at least one heat transfer path member comprises providing a solid bar configured to conduct heat to the external cooling source;

providing an interface to an external cooling source;

wherein the at least one heat transfer path member is configured to provide for heat to be removed to the external cooling source.

9. A method of manufacturing a cooled high-power vehicle inductor, the method comprising:

providing a first series of inductor windings around a central axis, the first series of inductor windings having an outer perimeter;

providing a second series of inductor windings around the central axis, the second series of inductor windings having an inner perimeter that is substantially outside the outer perimeter of the first series of inductor windings, wherein the second series of inductor windings is electrically coupled to the first series of inductor windings; and, providing at least one heat transfer path member between the first and the second series of inductor windings, wherein the at least one heat transfer path member is positioned parallel with the central axis, along the outer perimeter of the first series of inductor windings and the inner perimeter of the second series of inductor windings, wherein the at least one heat transfer path member forms a path for heat to be removed from between the first and the second series of windings, providing at least one heat transfer path member comprises providing an at least partially hollow member configured to move coolant fluid there through;

providing an interface to an external cooling source;

wherein the at least one heat transfer path member is configured to provide for heat to be removed to the external cooling source.

10. A method of manufacturing a cooled high-power vehicle inductor, the method comprising:

providing a first series of inductor windings around a central axis, the first series of inductor windings having an outer perimeter;

providing a second series of inductor windings around the central axis, the second series of inductor windings having an inner perimeter that is substantially outside the outer perimeter of the first series of inductor windings, wherein the second series of inductor windings is electrically coupled to the first series of inductor windings; and, providing at least one heat transfer path member between the first and the second series of inductor windings, wherein the at least one heat transfer path member is positioned parallel with the central axis, along the outer perimeter of the first series of inductor windings and the inner perimeter of the second series of inductor windings, wherein the at least one heat transfer path member forms a path for heat to be removed from between the first and the second series of windings, providing at least one heat transfer path member comprises providing an at least partially hollow member configured to receive a heat transfer insert, wherein the heat transfer insert provides for heat to be removed from the one heat transfer path member to the external cooling source;

providing an interface to an external cooling source;

wherein the at least one heat transfer path member is configured to provide for heat to be removed to the external cooling source.

11. A method of manufacturing a cooled high-power vehicle inductor, the method comprising:

providing a first series of inductor windings around a central axis, the first series of inductor windings having an outer perimeter;

providing a second series of inductor windings around the central axis, the second series of inductor windings having an inner perimeter that is substantially outside the outer perimeter of the first series of inductor windings, wherein the second series of inductor windings is electrically coupled to the first series of inductor windings; and, providing at least one heat transfer path member between the first and the second series of inductor windings, wherein the at least one heat transfer path member is positioned parallel with the central axis, along the outer perimeter of the first series of inductor windings and the inner perimeter of the second series of inductor windings, wherein the at least one heat transfer path member forms a path for heat to be removed from between the first and the second series of windings, providing at least one heat transfer path member comprises providing a first spacer disposed between the outer perimeter of the first series of inductor windings and the inner perimeter of the second series of inductor windings, and providing a second spacer disposed between the outer perimeter of the first series of inductor windings and the inner perimeter of the second series of inductor windings;

providing an interface to an external cooling source;

wherein the at least one heat transfer path member is configured to provide for heat to be removed to the external cooling source and the path for heat to be removed from between the first and the second series of windings is formed by the first spacer and the second spacer.

12. The method of claim 11, wherein the providing at least one heat transfer path member further comprises providing a first heat transfer insert made substantially from a thermally conductive material, the first heat transfer insert located between first spacer and the second spacer;

wherein the first heat transfer insert is configured to transfer heat from the cooled high-power vehicle inductor to the external cooling source.

13. The method of claim 12, wherein the providing the first heat transfer insert comprises providing an at least partially hollow member configured to receive a second heat transfer insert;

wherein the second heat transfer insert transfers heat from the first heat transfer insert to the external cooling source.

14. The method of claim 11, wherein the providing at least one heat transfer path member further comprises providing a forming insert located between the first spacer and the second spacer;

wherein the forming insert is subsequently removed from between the first spacer and the second spacer.

15. The method of claim 14, wherein the providing at least one heat transfer path member further comprises replacing the forming insert with a heat transfer insert between the first and the second series of inductor windings.

16. A method for cooling a high-power vehicle inductor, the high-power vehicle inductor including an inductor core having a central axis, a first series of inductor windings around the central axis, a second series of inductor windings around the central axis and the first series of inductor windings, wherein the second series of inductor windings is electrically coupled to the first series of inductor windings, at least one heat transfer path disposed between the first series of inductor windings and the second series of inductor windings, and an external cooling source interface the method comprising:

thermally coupling an external cooling source to the high-power vehicle inductor via the external cooling source interface;

removing heat from the between the first and the second series of inductor windings via the at least one heat transfer path;

wherein the high-power vehicle inductor further includes at least one thermally conductive heat transfer insert positioned in the at least one heat transfer path; and, wherein the removing heat from the between the first and the second series of inductor windings via the heat transfer path comprises transferring heat through the at least one thermally conductive heat transfer insert.

17. The method of claim 16, wherein the at least one thermally conductive heat transfer insert is at least partially hollow for transmitting a heat transfer fluid there through, and the external cooling source circulates a heat transfer fluid through the at least one thermally conductive heat transfer insert.

18. A method for cooling a high-power vehicle inductor, the high-power vehicle inductor including an inductor core having a central axis, a first series of inductor windings around the central axis, a second series of inductor windings around the central axis and the first series of inductor windings, wherein the second series of inductor windings is electrically coupled to the first series of inductor windings, at least one heat transfer path disposed between the first series of inductor windings and the second series of inductor windings, and an external cooling source interface, the method comprising:

thermally coupling an external cooling source to the high-power vehicle inductor via the external cooling source interface;

removing heat from the between the first and the second series of inductor windings via the at least one heat transfer path;

wherein the high-power vehicle inductor further includes a first heat transfer insert and a second heat transfer insert positioned in the at least one heat transfer path; and, wherein the removing heat from the between the first and the second series of inductor windings via the heat transfer path comprises transferring heat through first heat transfer insert at a first time and transferring heat through second heat transfer insert at a second time.

* * * * *